US006653917B2

(12) United States Patent
Kang et al.

(10) Patent No.: US 6,653,917 B2
(45) Date of Patent: Nov. 25, 2003

(54) HIGH-TEMPERATURE SUPERCONDUCTOR LOW-PASS FILTER FOR SUPPRESSING BROADBAND HARMONICS

(75) Inventors: Kwang Yong Kang, Taejon (KR); Seok Kil Han, Taejon (KR); Min Hwan Kwak, Chinju-si (KR); Dal Ahn, Chunan (KR)

(73) Assignees: Electronics and Telecommunications Research Institute, Taejon (KR); Telwave, Inc., Hwasung-si (KR)

( * ) Notice: Subject to any disclaimer, the term of this patent is extended or adjusted under 35 U.S.C. 154(b) by 0 days.

(21) Appl. No.: 09/953,445

(22) Filed: Sep. 17, 2001

(65) Prior Publication Data

US 2002/0163399 A1 Nov. 7, 2002

(30) Foreign Application Priority Data

Mar. 14, 2001 (KR) ..... 2001-13208

(51) Int. Cl.[7] ..... H01P 1/203; H01B 12/02

(52) U.S. Cl. ..... 333/995; 333/204; 333/175; 505/210; 505/701; 505/866

(58) Field of Search ..... 333/204, 175, 333/995, 81 A, 81 R; 505/210, 701, 866

(56) References Cited

U.S. PATENT DOCUMENTS 5,258,626 A * 11/1993 Suzuki et al. ..... 257/39
5,668,511 A * 9/1997 Furutani et al. ..... 333/204
5,893,026 A * 4/1999 Kim ..... 455/114

OTHER PUBLICATIONS

M. H. Kwak et al. Design Of High Temperature Superconducting Low–Pass Filter For Broad–Band Harmonic Rejection, Sep. 17–22, 2000, Applied Superconductivity Conference, Technology For The 21st Century, Pre–Conference Booklet.*

* cited by examiner

*Primary Examiner*—Brian Young
*Assistant Examiner*—John B Nguyen
(74) *Attorney, Agent, or Firm*—Jacobson Holman PLLC

(57) ABSTRACT

Disclosed is a high-temperature superconductor low-pass filter for removing broadband harmonics in a wireless communication system. The high-temperature superconductor low-pass filter includes a coupled line section and a transmission line section, in which the coupled line section is connected in parallel with the transmission line section. The coupled line section has two microstrip open-stub type parallel stripe lines stacked on a high-temperature superconductor, and the transmission line section has one stripe line. Since the high-temperature superconductor low-pass filter has attenuation poles at a stopband, it has stopband characteristics to 7–8 times wider than a cutoff frequency. The high-temperature superconductor low-pass filter can easily remove sub-harmonics which are inevitably occurred in the wireless communication system.

11 Claims, 8 Drawing Sheets

HIGH-TEMPERATURE SUPERCONDUCTOR LOW-PASS FILTER FOR SUPPRESSING BROADBAND HARMONICS

FIELD OF THE INVENTION

The present invention relates to a low-pass filter for a wireless communication system; and, more particularly, to a HTS low-pass filter for suppressing broadband harmonics.

DESCRIPTION OF THE PRIOR ART

Recently, as various wireless communication systems and services are developed intensively, the considerable performance improvement such as small insertion loss, high selectivity, high sensitivity and small size are needed in development of communication components for a cellular phone and a personal communication system. In order to satisfy these demands, the development of materials, design (circuits) and fabrication (processes) technologies are essential for the communication devices.

Since low-pass filter (LPF) is a frequency selective and passive device with low levels of attenuation, LPF is widely used to reject harmonics or spurious signals in a integrated mixer, a voltage controlled oscillator (VCO) and so on. But an open-stub type low-pass filter and a step-impedance type low pass filter have a narrow stopband (about 3 times of cutoff frequency in case of a conventional LPF).

FIGS. 1A and 1B show an equivalent circuit diagram and a schematic diagram of a conventional microstrip low-pass filter.

FIG. 1A shows the equivalent circuit diagram of the lumped-element low-pass filter designed through the transformation of impedance level and frequency scale from the prototype low-pass filter (not shown). The lumped-element low-pass filter (or $\pi$-type low-pass filter) includes an inductance $L_2$ corresponded to the microstrip transmission line, a first shunt capacitance $C_1$ and a second shunt capacitance $C_2$ corresponded to the two parallel microstrip open-stubs (in this case: $C_1=C_2$).

Referring to FIG. 1B, the conventional microstrip low-pass filter includes a crystalline substrate 180 (hereinafter, referred to as "an MgO substrate"), a signal transmission input port 150 and a signal transmission output port 160, two parallel stripe lines 170 of a microstrip open-stub type, a microstrip line 140 and a ground plane 190.

The signal transmission input port 150 and the signal transmission output port 160 are fabricated on both edges of the top face of the MgO substrate 180. Two parallel microstrip open-stubs 170 between the signal transmission input port 150 and the signal transmission output port 160 are perpendicular to a signal propagation direction. Therefore, the microstrip line 140 is perpendicular to two parallel microstrip open-subs 170. The groundplane (e.g., Au or Ag film) 190 is coated at the bottom (backside) of the MgO substrate 180.

In general, there are some problems in the conventional low-pass filter as described above. Since the conventional low-pass filter has a narrow stopband range in frequency domain, an interference occurred by the adjacent wireless communication systems and a noise generated by the communication system itself are quite serious.

SUMMARY OF THE INVENTION

It is, therefore, an object of the present invention to provide a low-pass filter having a high-efficiency broad stopband characteristics, in which attenuation poles and a frequency range of the stopband can be controlled easily.

In accordance with an aspect of the present invention, there is provided a low-pass filter comprising: a circuit pattern having at least one or more units, wherein the circuit pattern includes a coupled line section having a pair of parallel stripe lines and a transmission line section having a pair of parallel straight lines whose two ports of one side are opened and whose two ports of the other side are connected to each other, each port of one side of the pair of the parallel straight lines being connected with each port of one side of the coupled line section.

BRIEF DESCRIPTION OF THE DRAWINGS

Other objects and aspects of the invention will become apparent from the following description of the embodiments with reference to the accompanying drawings, in which.

DETAILED DESCRIPTION OF THE PREFERRED EMBODIMENTS

Figure 2A:
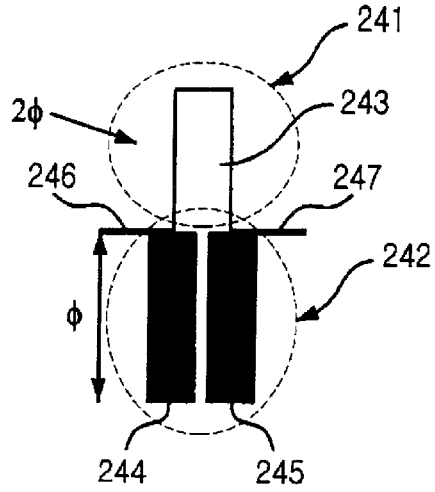
FIGS. 2A to 2C illustrate a schematic diagram, a basic circuit diagram and an equivalent circuit diagram of a high-temperature superconductor (HTS) coupled line low-pass filter in accordance with the present invention, respectively.

FIG. 2A shows a microstrip circuit of a high-temperature superconductor (HTS) low-pass filter (LPF) in accordance with an embodiment of the present invention. Referring to FIG. 2A, the HTS low-pass filter includes a transmission line section 241 and a coupled line section 242. The transmission line section 241 includes a microstripe line 243 and the coupled line section 242 includes a pair of parallel stripe lines 244 and 245.

The pair of the parallel stripe lines 244 and 245 are stacked on a HTS epitaxial thin film (not shown). A first lead line 246 is extended from the first parallel stripe line 244 to a signal transmission input port. A second lead line 247 is extended from the second parallel stripe line 245 to a signal transmission output port. The microstripe line 243 connects the first and the second parallel stripe lines 244 and 245. The microstripe line 243 is more slender and longer than the first and the second lead lines 246 and 247.

At this time, an electrical length ratio of the coupled line section to the transmission line section is approximately 1:2, and a distance from the first parallel stripe line 244 to the second parallel wire 245 is less than 10 $\mu$m. A width of the microstripe line 243 is less than that of the first and the second lead lines 246 and 247.

Figure 2B:
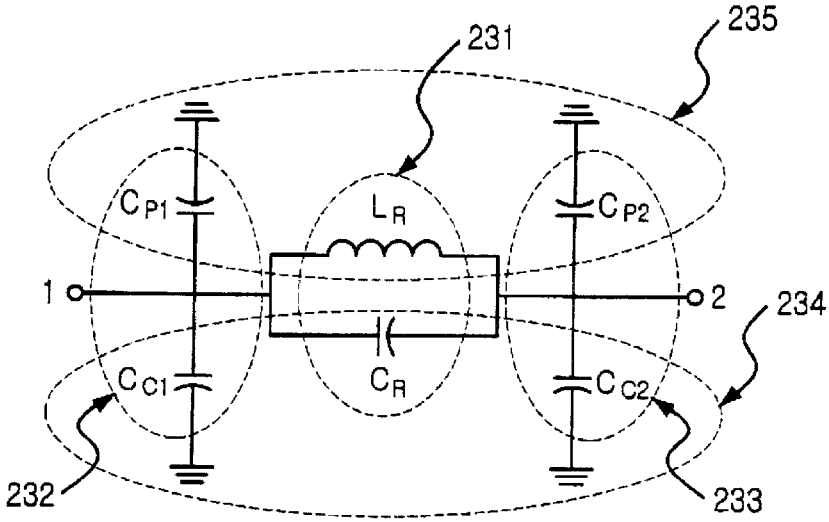

FIG. 2B shows an equivalent circuit of the high-temperature superconductor low-pass filter in FIG. 2A.

As shown in FIG. 2B, the HTS high-temperature superconductor low-pass filter includes a first π type equivalent circuit portion 235 corresponding to the transmission line section 241 and a second π type equivalent circuit portion 234 corresponding to the coupled line section 242.

Figure 1A:
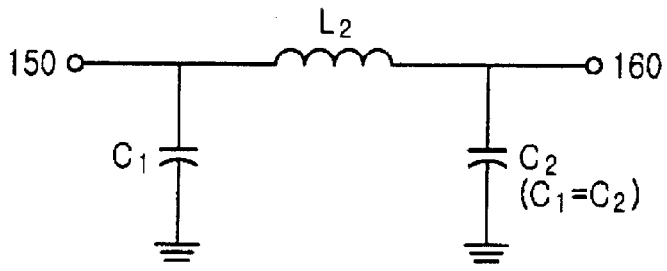
FIG. 1A (PRIOR ART)
FIGS. 1A and 1B show an equivalent circuit diagram and a schematic diagram of a conventional microstrip low-pass filter, respectively.
Figure 1B:
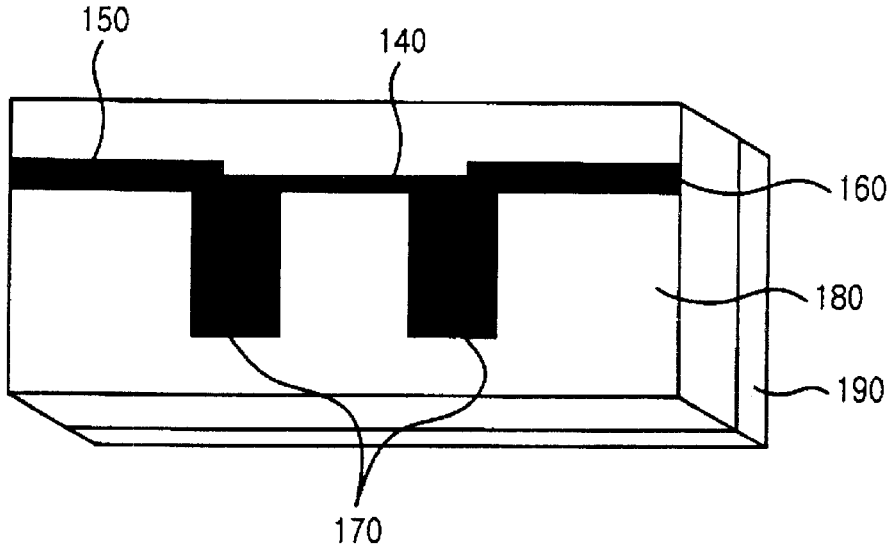
FIG. 1B (PRIOR ART)

Compared with the conventional low-pass filter shown in FIG. 1B, the high-temperature superconductor low-pass filter in accordance with the present invention further includes a third capacitor $C_R$. That is, an inductor $L_R$ is disposed between the signal transmission input port and the signal transmission output port. A first capacitor $C_{P1}$ is connected between the signal transmission input port and a ground, and a second capacitor $C_{P2}$ is connected between the signal transmission output port and the ground. The third capacitor $C_R$ is connected in parallel with the inductor LR between the first and the second capacitors $C_{P1}$ and $CP_2$. The first and the second capacitors $C_{P1}$ and $C_{P2}$ are constituted with capacitors $C_{C1}$ and $C_{C2}$ which are physically isolated, respectively.

Figure 2C:
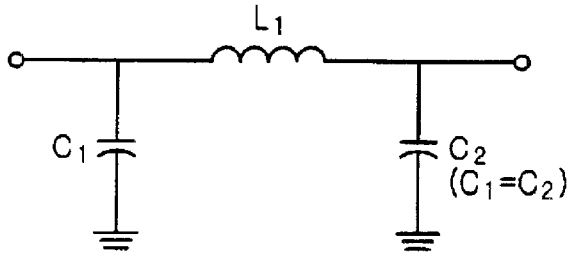

FIG. 2C shows an equivalent circuit of the high-temperature superconductor low-pass filter shown in FIG. 2B. As shown in FIG. 2C, the equivalent circuit diagram includes an inductor $L_1$ disposed between the signal transmission input port and the signal transmission output port, a first capacitor $C_1$ connected between the signal transmission input port and the ground, and a second capacitor $C_2$ connected between the signal transmission output port and the ground.

Such a low-pass filter has three attenuation poles due to the electrical length ϕ of the transmission line section and the coupled line section. Two attenuation poles are positioned at two points where a susceptance of a serial element becomes zero and one attenuation pole is positioned at a point where a susceptance of parallel elements becomes infinite.

Figure 3A:
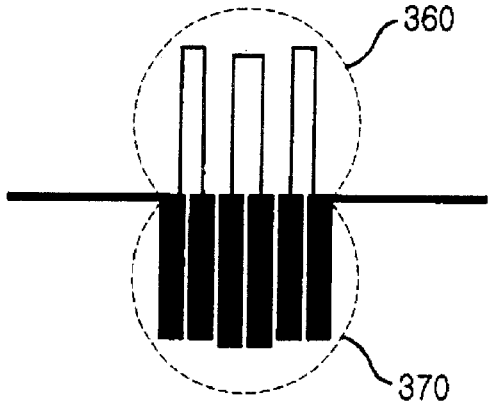
FIGS. 3A to 3C illustrate a schematic diagram, a basic circuit diagram and an equivalent circuit diagram of a seventh-order coupled line low-pass filter in accordance with the present invention, respectively.
Figure 3C:
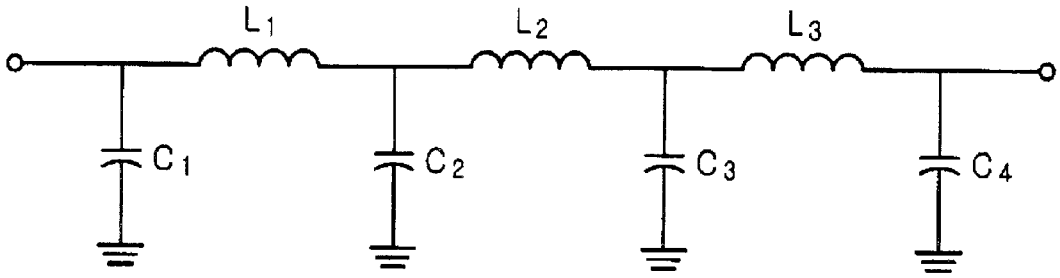
Figure 3B:
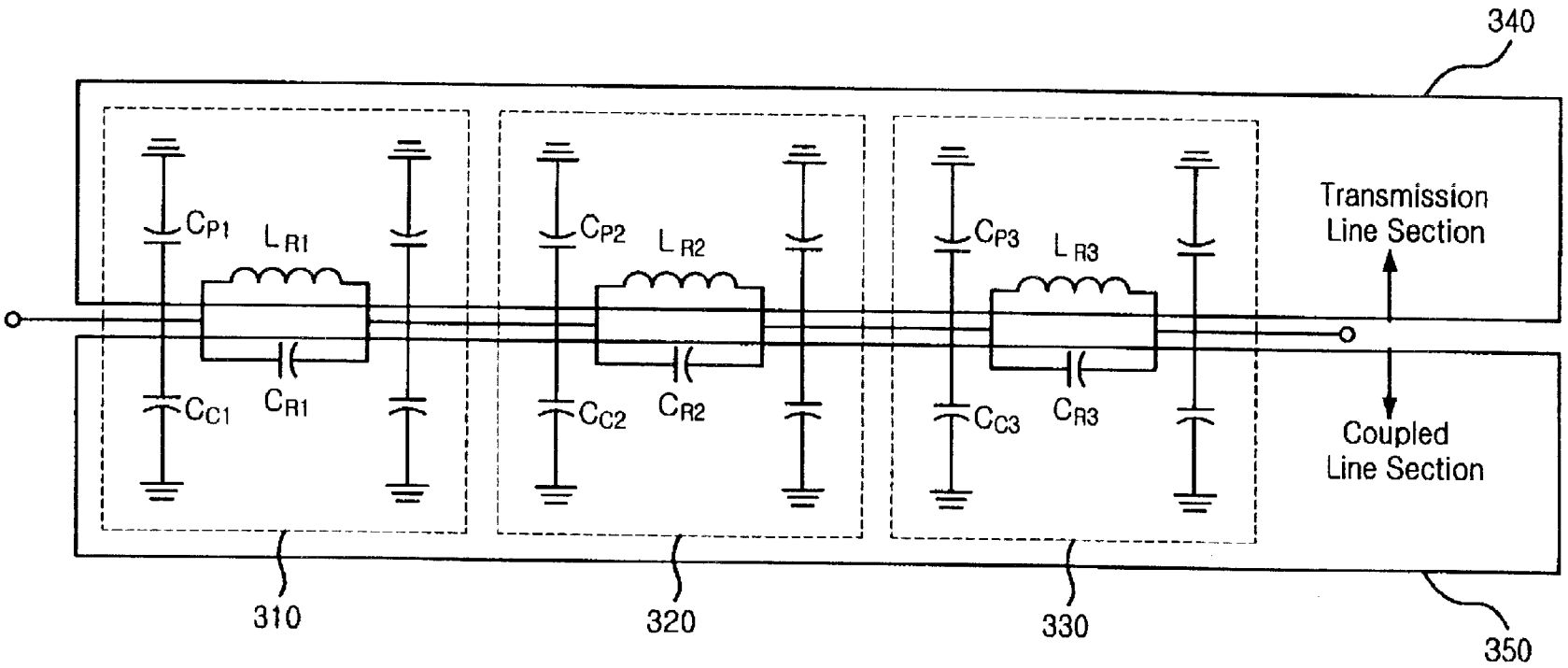

FIGS. 3A to 3C illustrate a schematic diagram, a basic circuit diagram and an equivalent circuit diagram of a seventh-order low-pass filter in accordance with the present invention, respectively.

Referring to FIG. 3A, the seventh-order low-pass filter includes a transmission line section 360 having three stripe lines and a coupled line section 370 having three pair of parallel stripe lines. Each stripe line is connected to each pair of the parallel stripe lines.

Compared with the high-temperature superconductor low-pass filter shown in FIG. 2A, three circuit patterns are serially connected between the signal transmission input port and the signal transmission output port.

FIG. 3B shows an equivalent circuit of the seventh-order low-pass filter in FIG. 3A. As shown, the seventh-order low-pass filter includes a first π type equivalent circuit portion 340 corresponding to the transmission line section 360 and a second π type equivalent circuit portion 350 corresponding to the coupled line section 370. Three circuit patterns 310, 320 and 330 are serially connected between the signal transmission input port and the signal transmission output port.

FIG. 3C shows an equivalent circuit of the seventh-order low-pass filter in FIG. 3B. Compared with the low-pass filter shown in FIG. 2C, the seventh-order low-pass filter includes three circuit patterns which are connected in series. Each circuit pattern includes an inductor $L_1$ disposed between the signal transmission input port and the signal transmission output port, a first capacitor $C_1$ connected between the signal transmission input port and the ground, and a second capacitor $C_2$ connected between the signal transmission output port and the ground.

According to a filter design of the present invention, respective parameters of the π type equivalent circuit are expressed as follows:

$$j\omega_0 C_1 = j\omega_0 C_c + j\omega_0 C_p \quad \text{(Eq. 1)}$$

$$j\omega_0 L_2 = \frac{1}{j\omega_0 C_r + \frac{1}{j\omega_0 L_r}} \quad \text{(Eq. 2)}$$

where, $j\omega_o C_r = j\,(Y_{oo} - Y_{oe})/2 * \tan\phi$, $j\omega_o L_r = jZ_o \sin 2\phi$. Here, $\omega_0$ denotes a cutoff frequency of the proposed low-pass filter, C capacitance of low-pass filter, L inductance of low-pass filter, $Y_{00}$ an odd mode admittance of a coupled line, $Y_{oe}$ an even mode admittance of the coupled line, $Y_o$ a characteristic admittance and ϕ an electrical length of a coupled line.

Using a transmission line and coupled line theory together with the equations 1 and 2, a susceptance (an imaginary number portion of an admittance in relation to a conductivity) is expressed as follows:

$$\frac{1}{j\omega_0 L_n} = j\frac{Y_{00} - Y_{oe}}{2}\tan\phi - jY_0 csc2\phi \quad \text{(Eq. 3)}$$

$$j\omega_0 C_n = jY_{oe}\tan\phi + jY_0 \tan\frac{\phi}{2} \quad \text{(Eq. 4)}$$

The low-pass filter expressed as these physical parameters has three attenuation poles due to the electrical length ϕ of the transmission line section and the coupled line section. Two attenuation poles are positioned at two points where the susceptance of serial elements in the equation 3 becomes zero and one attenuation pole is positioned at a point where a susceptance of parallel elements in the equation 4 becomes infinite.

Since the attenuation poles are dispersedly positioned at the stopband of the low-pass filter, the frequency range of the stopband is expanded up to ten times of the cutoff frequency. Also, a device size can be scaled down remarkably. That is, the positions and the number of the attenuation poles are controlled adjusting the electrical length of the transmission line section and the coupled line section, so that it is possible to implement the low-pass filter having a broad stopband.

Figure 4A:
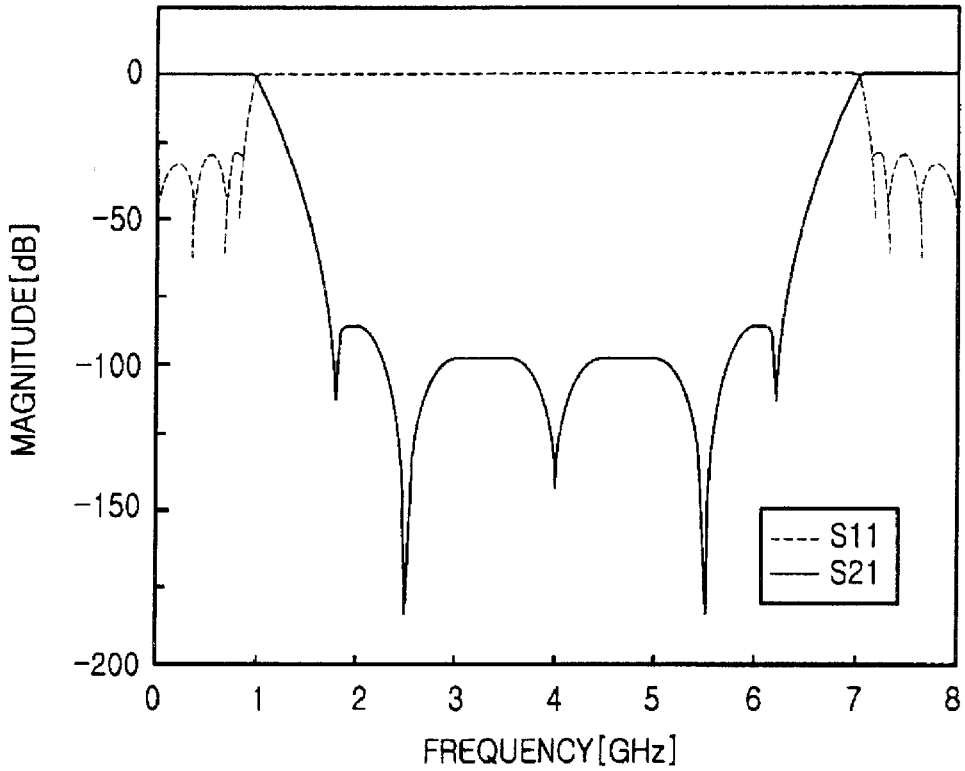
FIGS. 4A and 4B are graphs illustrating simulated results of the seventh-order coupled line low-pass filter shown in FIG. 3A.
Figure 4B:
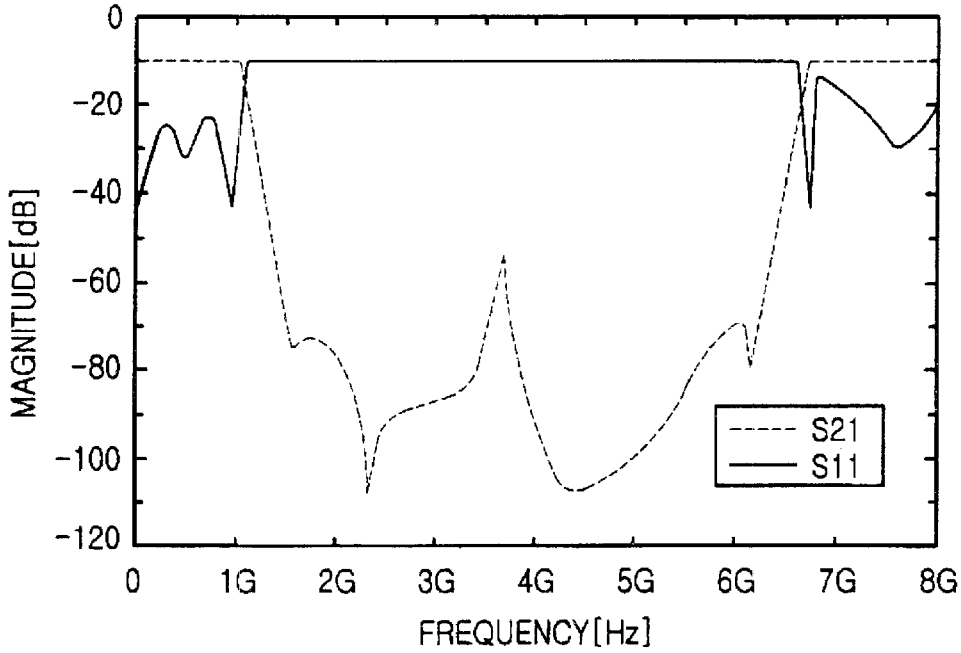

FIG. 4A is a graph illustrating simulation results of the seventh-order low-pass filter which is designed to have five attenuation poles. A cutoff frequency of the seventh-order low-pass filter is 900 MHz with a ripple level of 0.01 dB. FIG. 4B is a graph illustrating simulation results obtained using an EM simulator in order to design actually the low-pass filter based on the simulation results.

As shown, the seventh-order low-pass filter in accordance with the present invention has a symmetrically elliptic low-pass characteristic at the center of 4 GHz. The attenuation poles are positioned at 1.5 GHz, 2.4 GHz, 3.8 GHz, 4.4 GHz and 6.1 GHz. The seventh-order low-pass filter exhibits an improved characteristic stopband in the range from 1 to 7 GHz at the cutoff frequency of 1 GHz.

FIGS. 5A to 5F are cross-sectional views illustrating sequential steps associated with a method for fabricating the seventh-order low-pass filter.

Figure 5A:
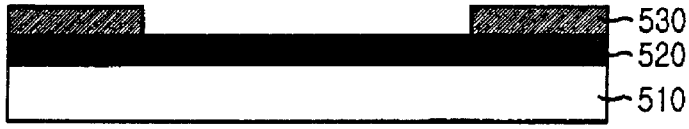
FIGS. 5A to 5F are cross-sectional views illustrating sequential steps associated with a method for fabricating the seventh-order coupled line low-pass filter.

Referring to FIG. 5A, a high-temperature superconductor (HTS) $YBa_2Cu_3O_{7-x}$ (YBCO) epitaxial thin film 520 is grown on an MgO substrate 510 in a C-axis direction. Then, an Au/Cr film 530 is formed on the HTS YBCO epitaxial thin film 520.

Figure 5B:
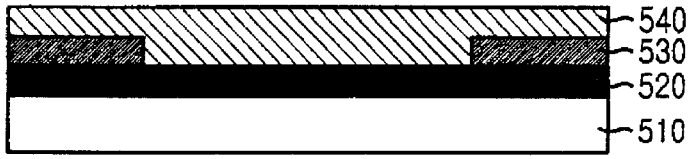

Referring to FIG. 5B, a photoresist 540 is formed on an entire structure using a spin coating method.

Figure 5C:
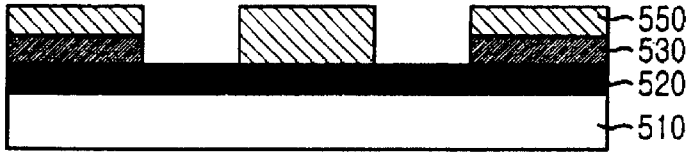

Referring to FIG. 5C, a predetermined portion of the photoresist 540 is removed through an exposure of an ultraviolet (UV) source to thereby form a photoresist pattern 550 and mask aligner to form a photoresist pattern 550.

Figure 5D:
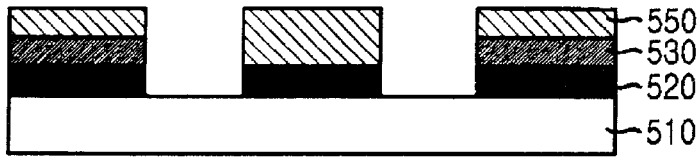

Referring to FIG. 5D, the HTS YBCO epitaxial thin film 520 with metal films 530 and photoresist pattern 550 is formed through the standard photolithographic and ion-milling etching processes.

Figure 5E:
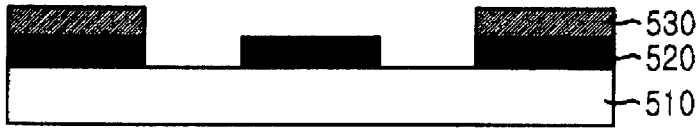

Referring to FIG. 5E, after the photoresist pattern 550 is removed by acetone, an Au/Cr pad 530 is formed by using a lift-off method to good contact with a K-connector.

Figure 5F:
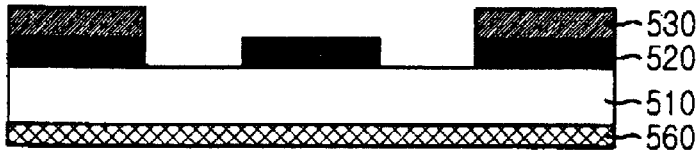

Referring to FIG. 5F, the groundplane 560 is fabricated by sputtering of the metal film (Cr/Ag film).

Figure 6:
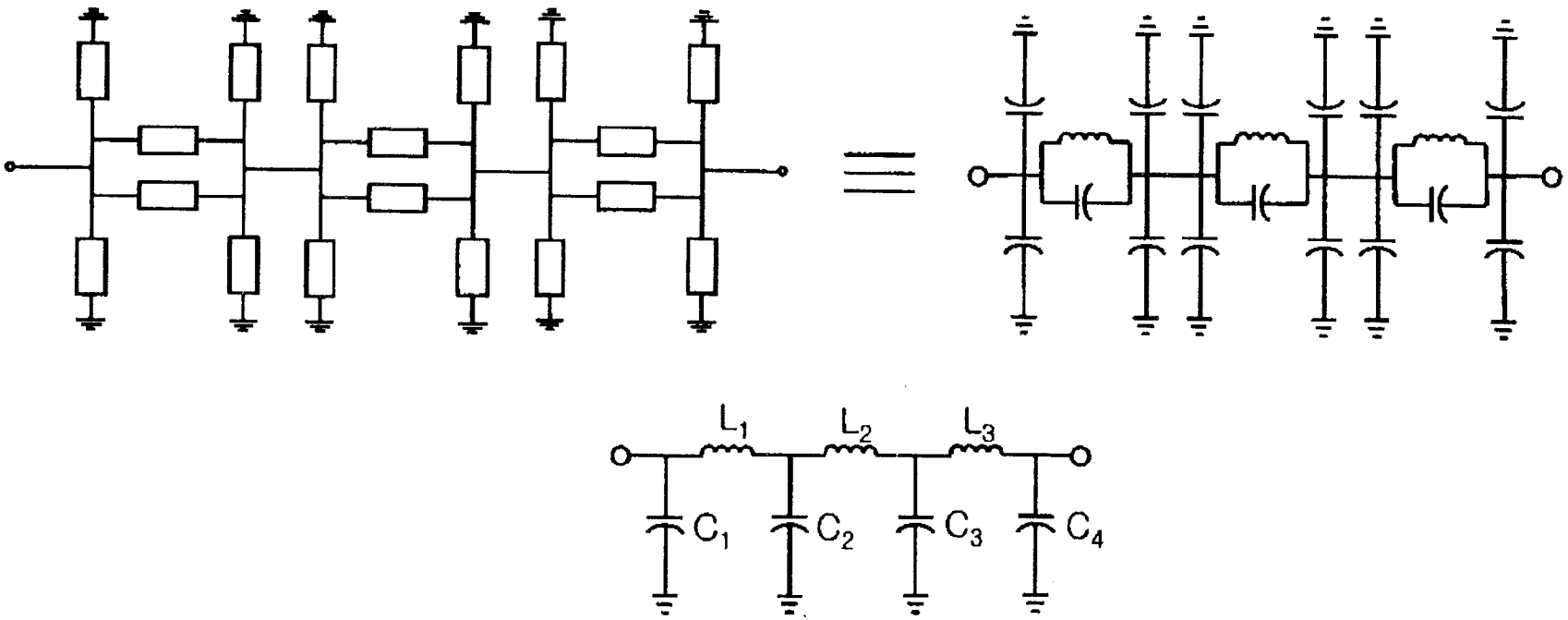
FIG. 6 shows comparison of the simulated and measured results of the seventh-order HTS coupled line low-pass filter.

FIG. 6 shows comparison of the simulated and measured results of the seventh-order HTS coupled line low-pass filter. The measured results are identical to the EM simulations.

The HTS coupled line low-pass is fabricated using the HTS YBCO thin film grown on MgO substrate through surface treatment (polishing). Even if the HTS coupled line low-pass filters are fabricated as microstrip type, the microwave losses can be reduced considerably due to a very low surface resistance of HTS epitaxial films.

The planar type HTS coupled line low-pass filter for suppression of harmonics and spurious signals can be applied to the various wireless communication systems for the remarkable improvement of a skirt characteristic as well as a broadband harmonics rejection characteristic, and reduction of interferences and noises.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A low-pass filter comprising:

a circuit pattern having at least one unit, wherein the unit of the circuit pattern includes a coupled line section having a pair of parallel stripe lines; and a transmission line section having a pair of microstrip lines whose two ports of one side are opened and whose two ports of the other side are connected to each other, and wherein each port of one side of the microstrip lines being connected to one side of the coupled line section.

2. The low-pass filter as recited in claim 1, wherein the circuit pattern includes two or more than units, the units of the circuit pattern being connected in series.

3. The low-pass filter as recited in claim 2, wherein the circuit pattern includes three units connected in series.

4. The low-pass filter as recited in claim 2, wherein physical parameters of the circuit pattern are determined by symmetrically elliptic low-pass characteristics.

5. The low-pass filter as recited in claim 4, wherein the physical parameters include an electrical length of the transmission line section and the coupled line section.

6. The low-pass filter as recited in claim 3, wherein physical parameters of the circuit pattern are determined by symmetrically elliptic low-pass characteristics.

7. The low-pass filter as recited in claim 6, wherein the physical parameters include an electrical length of the transmission line section and the coupled line section.

8. The low-pass filter as recited in claim 1, further comprising:

a lead section including two lead lines, wherein one lead line is extended from the pair of the parallel stripe lines to an input port of the low-pass filter and the other lead is extended from the pair of the parallel stripe lines to an output port of the low-pass filter, a width of a stripe line of the transmission line section being smaller than that of two lead lines.

9. The low-pass filter as recited in claim 1, wherein a width between the pair of the parallel stripe lines of the coupled line section is less than 10 $\mu$m.

10. The low-pass filter as recited in claim 1, wherein an electrical length ratio of the coupled line section to the transmission line section is 1:2.

11. The low-pass filter as recited in claim 1, wherein the transmission line section and the coupled line section are formed using a high-temperature superconductor epitaxial thin film.

* * * * *